US009844971B2

(12) United States Patent
Reda et al.

(10) Patent No.: US 9,844,971 B2
(45) Date of Patent: Dec. 19, 2017

(54) PAPER BINDING FASTENERS

(71) Applicants: Ronald F. Reda, Orland Park, IL (US); Allen Polowinczak, New Lennox, IL (US)

(72) Inventors: Ronald F. Reda, Orland Park, IL (US); Allen Polowinczak, New Lennox, IL (US)

( * ) Notice: Subject to any disclaimer, the term of this patent is extended or adjusted under 35 U.S.C. 154(b) by 0 days.

(21) Appl. No.: 14/757,139

(22) Filed: Nov. 24, 2015

(65) Prior Publication Data

US 2016/0144653 A1 May 26, 2016

Related U.S. Application Data

(60) Provisional application No. 62/123,674, filed on Nov. 24, 2014.

(51) Int. Cl.

| | |
|---|---|
| ***B42F 13/12*** | (2006.01) |
| ***B42F 3/00*** | (2006.01) |
| ***B42F 15/00*** | (2006.01) |
| ***B42F 13/14*** | (2006.01) |
| ***B42F 13/06*** | (2006.01) |
| ***B42F 3/04*** | (2006.01) |

(52) U.S. Cl.

CPC ..... *B42F 15/0058* (2013.01); *B42F 3/04* (2013.01); *B42F 13/06* (2013.01); *B42F 13/14* (2013.01)

(58) Field of Classification Search

CPC ..... B42F 15/0058; B42F 13/08; B42F 13/10; B45F 3/04; Y10T 24/201; Y10T 24/209; Y10T 24/44026; B65D 63/1063; B65D 63/1036

See application file for complete search history.

(56) References Cited

U.S. PATENT DOCUMENTS

| | | | | |
|---|---|---|---|---|
| 3,339,247 | A * | 9/1967 | Geisinger | B65D 63/1027 24/16 PB |
| 3,970,331 | A * | 7/1976 | Giulie | B42B 5/08 281/21.1 |
| 5,121,524 | A * | 6/1992 | Mortensen | B65D 63/1036 24/16 PB |
| 6,347,435 | B1 * | 2/2002 | Davignon | B65D 63/1063 24/16 PB |
| 6,736,563 | B1 * | 5/2004 | With | B42F 3/04 281/21.1 |
| 7,861,487 | B2 * | 1/2011 | Kufner | E04F 21/0092 33/526 |
| 8,079,199 | B1 * | 12/2011 | Kufner | E04F 13/0892 33/526 |

(Continued)

*Primary Examiner* — Robert J Sandy

(57) ABSTRACT

A paper binding system utilizing standard single, double or three-hole paper punches allows for binding variable numbers of pages. System uses 2 members; a first member is an elongated tail with an elongated rib and round integrated head on top. A second clamping member attaches to the tail. Second member has a blade that engages the rib. Excess tail can be cut off with scissors. Second member can be removed by inserting a rod into the second member. The rod is inserted in an oval shaped hole with the rod at approximately at a 90 degree to the blade. It goes behind the blade and then travels up a beveled ramp of the rib thereby raising the blade slightly and disengaging the blade from the rib allowing the second member to be removed from the first member.

9 Claims, 11 Drawing Sheets

(56) References Cited

U.S. PATENT DOCUMENTS

| | | | | |
|---|---|---|---|---|
| 9,010,064 | B1 * | 4/2015 | Farahmandpour | E04B 1/7616 52/714 |
| 2003/0177613 | A1 * | 9/2003 | Caveney | B65D 63/1036 24/16 PB |
| 2011/0162171 | A1 * | 7/2011 | Gmeilbauer | F16B 2/08 24/16 R |
| 2015/0252832 | A1 * | 9/2015 | Le Grange | F16B 2/08 24/582.1 |

* cited by examiner

100

200

300

400

500

600

900

1000

1900

PAPER BINDING FASTENERS

CROSS-REFERENCE

Provisional Patent Application No. 62/123,674

TECHNICAL FIELD

This invention relates to the field of binding paper together.

BACKGROUND OF THE INVENTION

Currently in order to bind paper together one would have numerous options to do so from very inexpensive to more expensive. The easiest is of course a simple stapler. Other options would be to use different sorts of hole punching devices first to punch the hole (3 hole vertical along left margin, 2 hole horizontal along top, rectangle holes along left margin for comb style etc.) and then some sort of fastener to hold the paper together. For example there are brass brads that go through the holes and then spread apart on the other side, these brads are not very good as it is not tight enough to bind the paper and tears the paper apart because the edges are very sharp. There is also a 3 ring folder that has 3 rings inside that snap open and shut, one would first need to punch paper with 3 holes or buy the paper with the 3 holes already in it; this is the most common punch in any office and the cheapest. One would then put the paper in and then close the 3 rings thereby capturing the paper. This 3 ring binder as it is known is expensive, very bulky and cannot be filed in file cabinets. The 3 ring binder system also needs many sizes of it in stock in an office, as a 50-page document would require a much different size binder than a 500-page document. The paper in these 3 ring binders also tear very easily as the paper is not really bound but rather loosely held together and the single pages easily tear from the metal rings. Another example would be the comb process, one would need to buy an expensive machine to punch numerous rectangle holes vertically along the left margin of the paper and then with the same machine you hold open the plastic "comb" and insert the paper after the paper is in place you release the comb and it goes back to its original shape and holds the paper loosely in place. This process does not allow for filing in file cabinets and also requires numerous comb sizes in stock to achieve the proper binding of different size documents. Again this is a very expensive endeavor and has a very high level of error if you don't punch the square holes exactly in the right position the bound document is a mess and the comb may not go through all the sheets. This comb system is also very difficult to take apart if necessary and put back together. Another example is a 2 hole punch that is punched at the top of the paper, one would need to buy an inexpensive 2 hole punch and then one would buy a 2 hole clasp that is either already attached to some sort of folder or you would attach it via a pre-glued sticky back onto a folder. This 2 hole method is not used for presentation documents but filing legal docs most of the time in a legal folder. All these methods are often cumbersome to achieve, cause a high level of mistakes in the process, don't provide a professional looking finished piece and with some of them can be an expensive endeavor to buy the punch and the special clips to mate only their press.

The present invention is provided to solve the problems discussed above and other problems, and to provide advantages and aspects not provided by prior Paper Binding methods of this type. A full discussion of the features and advantages of the present invention is deferred to the following detailed description, which proceeds with reference to the accompanying drawings.

BRIEF SUMMARY OF THE INVENTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. The present invention solves all the problems of the prior methods by having a two-piece paper binder system that scales from 1 piece of paper to many pieces of paper. When used said system has incredible clamping power keeping pages tightly bound and is cable of being easily and cheaply used and taken apart. Two-piece system has several versions utilizing the same clamping structure. It has a single, double and triple tail system. The present invention is capable of being filed, this is very unique as most documents need a hanging file to be filed whereas this invention can be suspended in the file cabinet by itself with the attached hanger that can be assembled with the binder system. The present invention is very inexpensive as it will be injection molded of an inexpensive plastic. The present invention makes for a beautiful presentation piece, allowing for great creative freedom. The cover of the presentation can be customized to whatever the need is because it is standard paper. The invention is thin and to the far left or very top of the paper allowing lots of room and is almost not noticed at all especially if the binder is made of a clear material. The present invention is scalable for many sizes of binding and does not require lots of inventory, the tail of the first member is of a length that allows for small to very large documents, after you clamp the 2 members together you simple cut or break off the remaining part of the tail making it a custom length to the size of your document. The present invention is easily taken apart and put back together with ease. The present invention has a snap on plate that allows for a place to put a label on the spine for viewing in a file cabinet. The second member-clamping device is capable of being released with a simple paper clip or with the release rod provided. You simple push the rod of a paper clip into a hole that is perpendicular to the locking blade and it is released from the first member tail. Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE INVENTION

Figure 1:
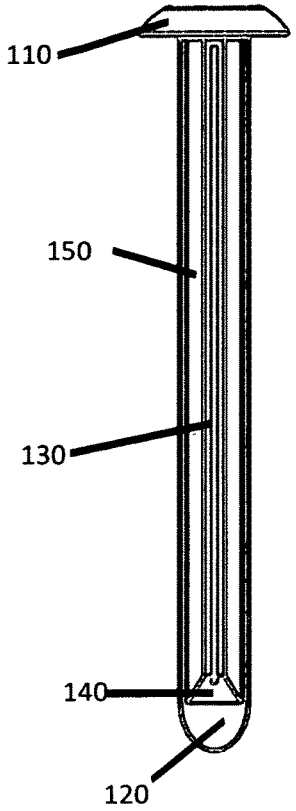
FIG. 1 is a perspective view of the invention showing the first members dome top with its integral tails front face with the raised profile running down the center of the tail.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As illustrated in FIG. 1, in accordance with one or more embodiments of the present invention a plastic body possibly injection molded forms the main structure of the first member tail. There is a elongated integral tail 120 that extends outwards at a 90 degree angle from the top dome 110. Top dome 110 is a larger diameter than elongated tail 120 so top dome 110 will not pass through punched holes in paper when binding paper. Running parallel with the tail 120 on one side of the tail 120 is a raised profile rib 130 for the blade 530 to engage with. Along both sides of the raised profile rib 130 running parallel to it is a beveled ramp 150. At the end of the profile rib 130 is another bevel 140 to allow for easy insertion into second clamping member 510.

Figure 2:
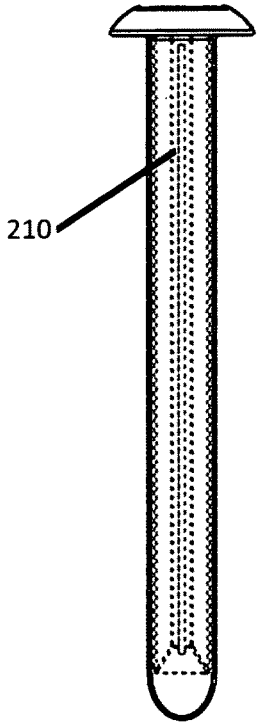
FIG. 2 is a perspective view of the invention showing the first members tails back side with no raised profile but entirely flat.

As illustrated in FIG. 2, in accordance with one or more embodiments of the present invention the back side of the tab is flat 210

Figure 3:
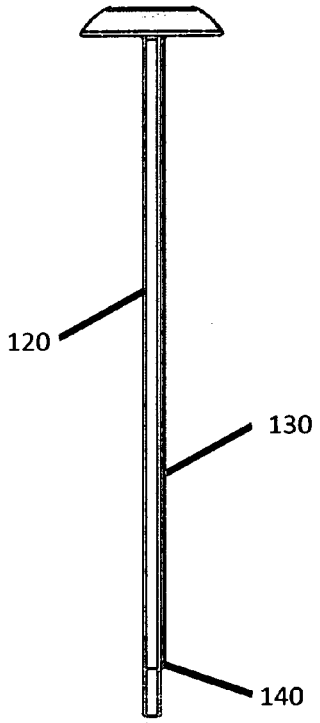
FIG. 3 is a perspective view of the present invention showing the first member tails side view.

As illustrated in FIG. 3, in accordance with one or more embodiments of the present invention, shows the main structure of the tail in a side view 120. The raised profile 130 is evident along the tail. At the end of the tail 140 is the beveled insertion point.

Figure 4:
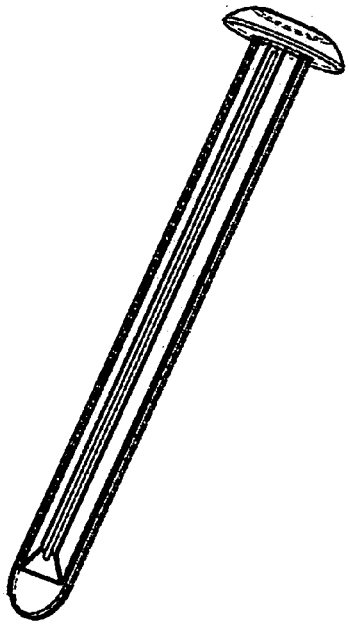
FIG. 4 is a perspective view of the present invention showing the first member in an isometric view.

As illustrated in FIG. 4, in accordance with one or more embodiments of the present invention shows the tail in an isometric view 400

Figure 5:
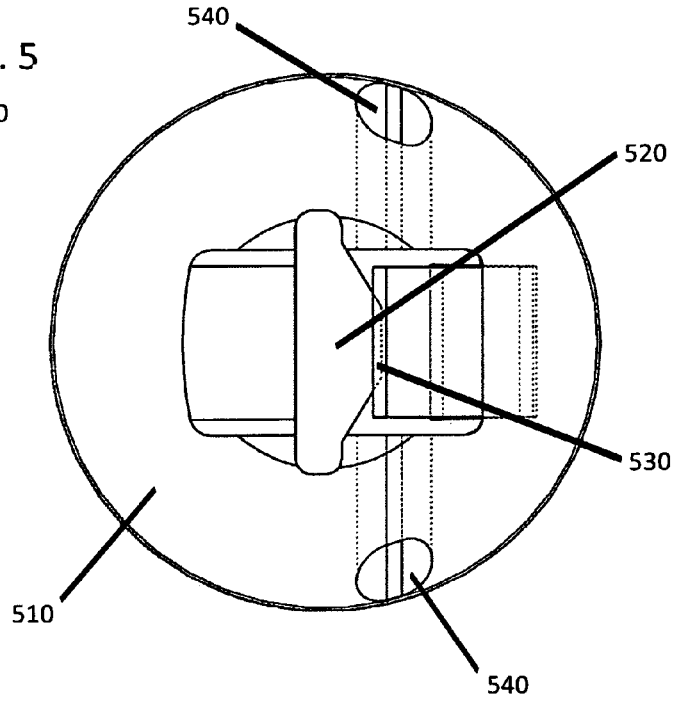
FIG. 5 is a perspective view of the present invention showing the second clamping members top view.

As illustrated in FIG. 5, in accordance with one or more embodiments of the present invention shows the second clamping members top view 510. A cut through 520 from the top through to the bottom this allows the tail 120 to pass through. The shape of the pass through 520 only allows for the tail 120 to go in one way and orientate itself in the proper direction. The blade 530 peeks through and over laps the opening 520 causing interference with the tail 120. Ejection holes 540 are shown where the ejection rod 1410 enters and releases blade 530 from tail 120.

Figure 6:
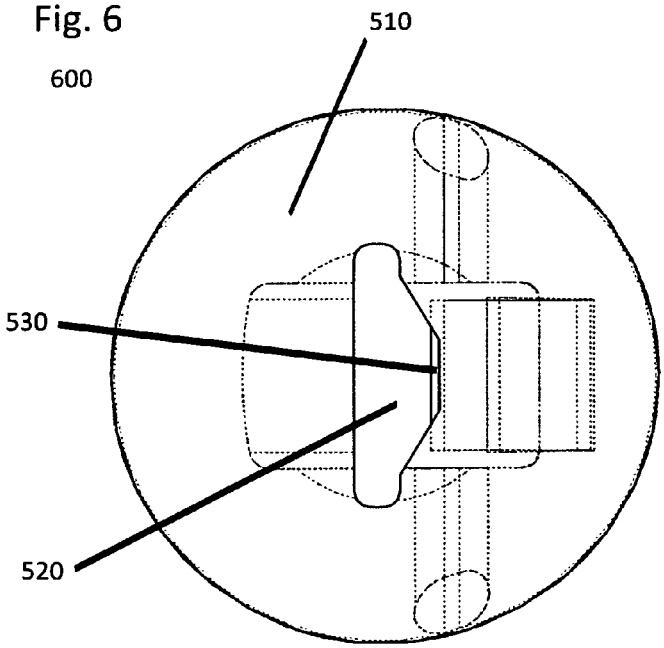
FIG. 6 is a perspective view of the present invention showing the second clamping members underneath or back view.

As illustrated in FIG. 6, in accordance with one or more embodiments of the present invention shows the back side of the second clamping member 510. The blade 530 is again shown interfering with the pass through 520 for the tail of the first member 120.

Figure 7:
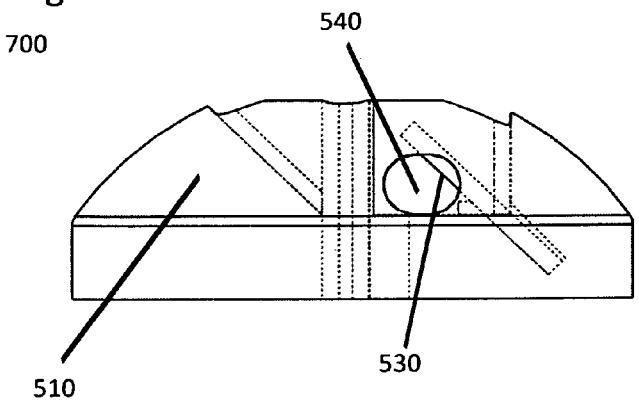
FIG. 7 is a perspective view of the present invention showing the second clamping member in a side view.

As illustrated in FIG. 7, in accordance with one or more embodiments of the present invention shows a side view of the second clamping member 510. This side view allows one to see through the ejection holes 540 and see the blade 530

Figure 8:
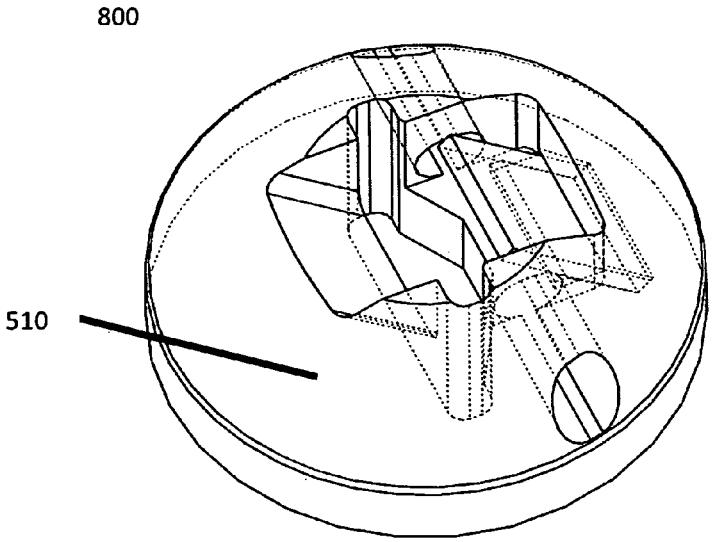
FIG. 8 is a perspective view of the present invention showing the second clamping member in an isometric view

As illustrated in FIG. 8, in accordance with one or more embodiments of the present invention showing an isometric view of the second clamping member 510.

Figure 9:
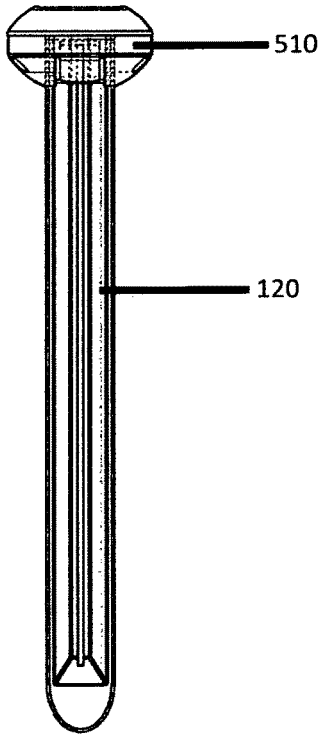
FIG. 9 is a perspective view of the present invention showing an assembly view with the first and second clamping members in the closed position.

As illustrated in FIG. 9, in accordance with one or more embodiments of the present invention shows the front view of the first member 120 and second clamping member 510 assembled in a closed position.

Figure 10:
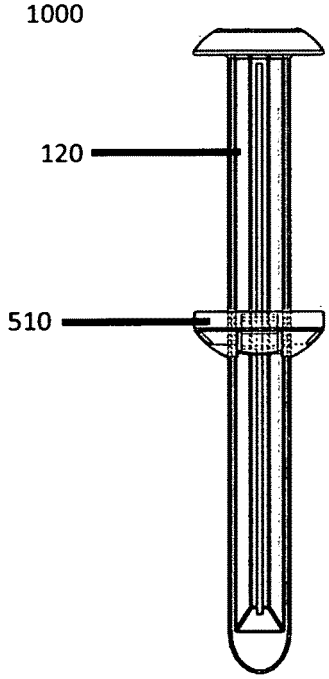
FIG. 10 is a perspective view of the present invention showing an assembly view with the first and second clamping members in the open position.

As illustrated in FIG. 10, in accordance with one or more embodiments of the present invention shows the front view of the first member 120 and second clamping member 510 assembled in a opened position.

Figure 11:
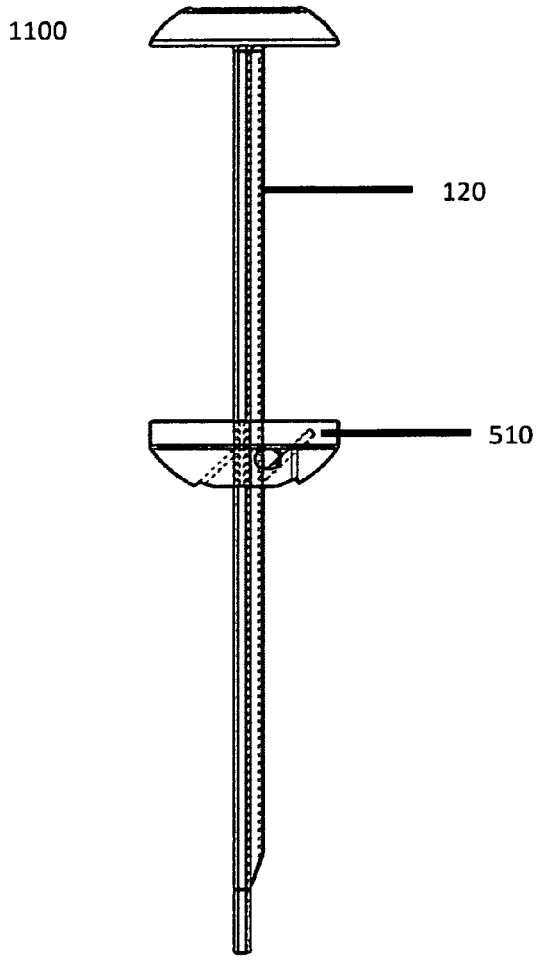
FIG. 11 is a perspective view of the present invention showing an assembly view with the first and second clamping members in a side view in the open position.
Figure 12:
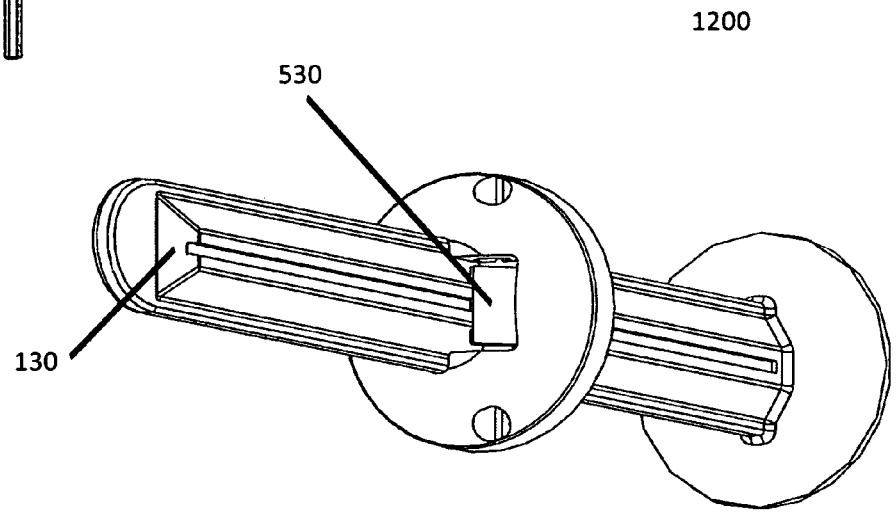
FIG. 12 is a perspective view of the present invention showing an isometric view of the first member and second clamping member in a close up with the blade from the second clamping member engaged in the tail of the first member.

As illustrated in FIG. 11, in accordance with one or more embodiments of the present invention shows a side view of the assembled first member tail 120 and second clamping member 510 in the open position As illustrated in FIG. 12, in accordance with one or more embodiments of the present invention shows an isometric view of the first member tail 120 and second clamping member 510 assembled in an open position. Blade 530 is shown engaged in first members raised rib profile 130

Figure 13:
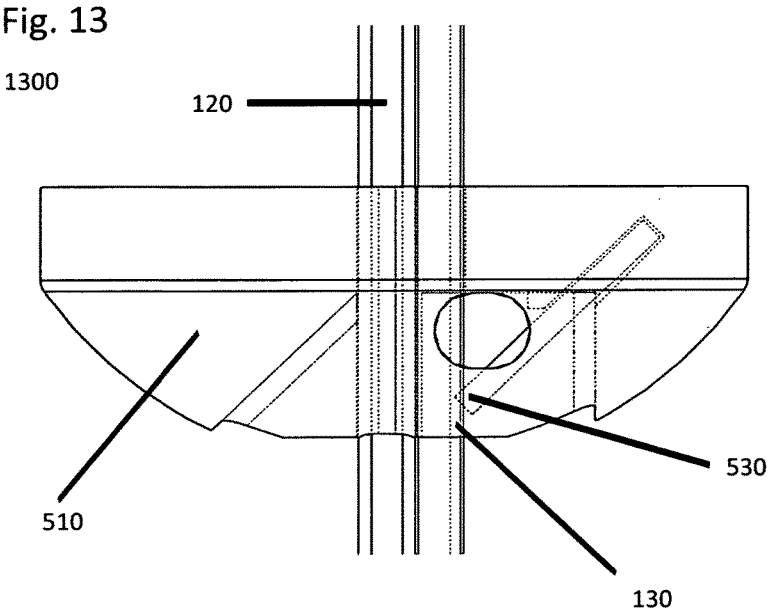
FIG. 13 is a perspective view of the present invention showing a close up side view of the second clamping member attached to the tail of the first member with the blade engaged in the first members rib.

As illustrated in FIG. 13, in accordance with one or more embodiments of the present invention shows a close up of the second clamping member 510 and the first member tail 120 assembled. The blade 530 is shown engaged into the raised rib profile 130 and holding it static.

Figure 14:
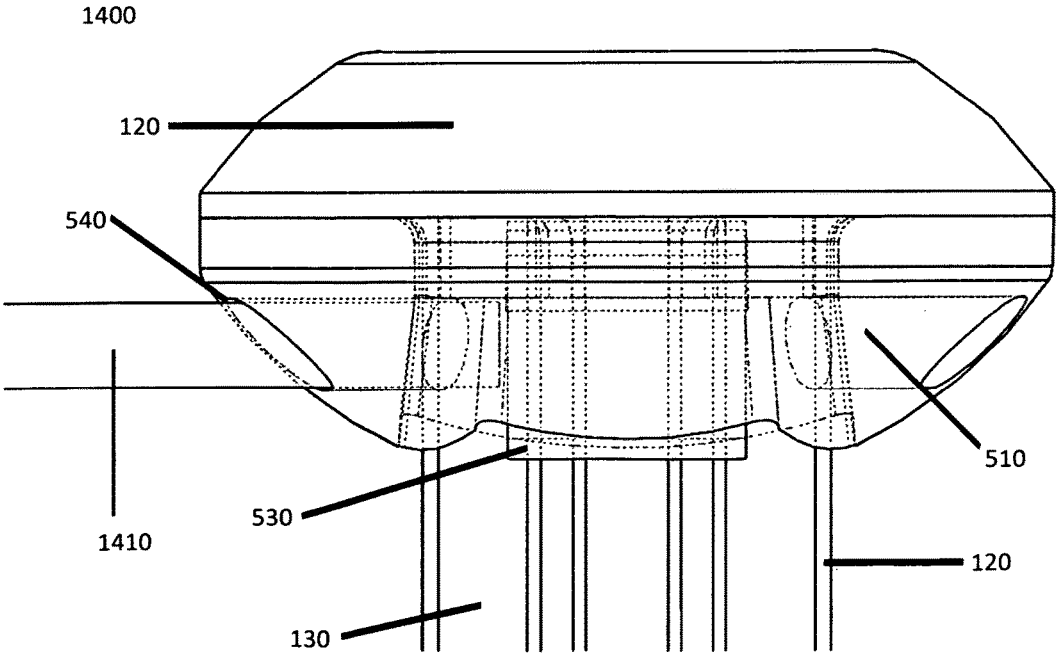
FIG. 14 is a perspective view of the present invention showing the first member and second clamping member in a close up in the closed position. Second clamping member shows ejection rod beginning to enter hole in second clamping member.

As illustrated in FIG. 14, in accordance with one or more embodiments of the present invention shows a close up of the second clamping member 510 and the first member tail 120 assembled in a closed position with the ejection rod 1410 entering the ejection hole 540. Ejection rod 1410 makes contact with the raised ribs profile ramp 130 as it is pushed further in it goes behind the blade 530 which is still engaged with raised profile 130.

Figure 15:
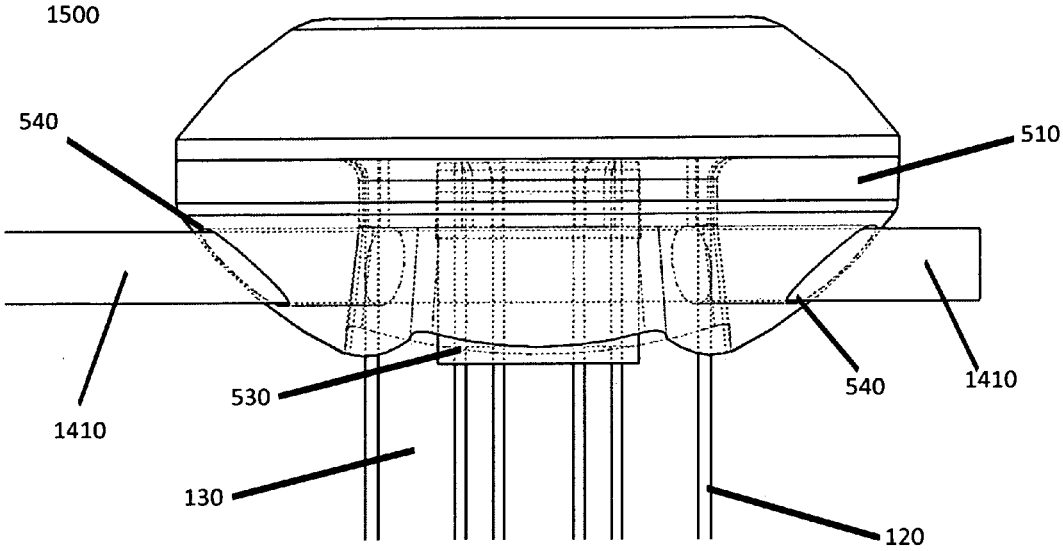
FIG. 15 is a perspective view of the present invention showing the first member and second clamping member in a close up in the closed position. Second clamping member shows ejection rod all the way through the ejection hole and under the blade. Blade is now released from first member.

As illustrated in FIG. 15, in accordance with one or more embodiments of the present invention shows a close up of the second clamping member 510 and the first member tail 120 assembled in a closed position with the ejection rod 1410 entering the ejection hole 540. As ejection rod 1410 passes through the second clamping member it will find its way behind blade 530. After sliding behind blade 530 it will start to slide up the ramp of the raised rib profile 130. As the ejection rod 1410 gets higher up the ramp and further into the ejection hole 540 the ejection rod 1410 is constrained to a certain position within the ejection hole 540. This position forces the ejection rod 1410 to engage and lift the blade 530 off the raised rib profile surface 130.

Figure 16:
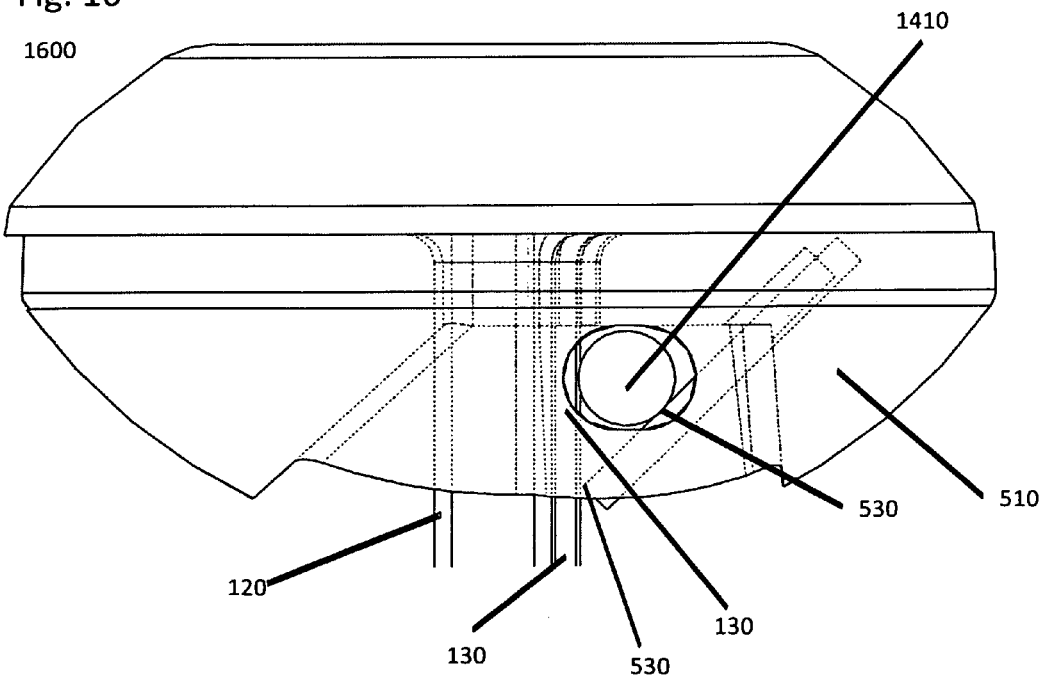
FIG. 16 is a perspective view of the present invention showing the first member and second clamping member in a close up in the closed position. This side view shows the ejection rod making contact with the blade and lifting it off the surface of the rib.

As illustrated in FIG. 16, in accordance with one or more embodiments of the present invention shows a close up of the second clamping member 510 and the first member tail 120 assembled in a closed position in a side view. Ejection rod 1410 has passed completely through second clamping member 510. Ejection rod 1410 has slide up the ramp of the raised rib profile 130 of the first member tail 120 and now sits on top of the raised rib profile 130, this action has resulted in putting pressure on the backside of the blade 530 and has lifted the edge of the blade 530 off the raised rib profile 130 of the first member tail 120 thereby releasing the second clamping member 510 from the first member tail 120 to be taken apart.

Figure 17:
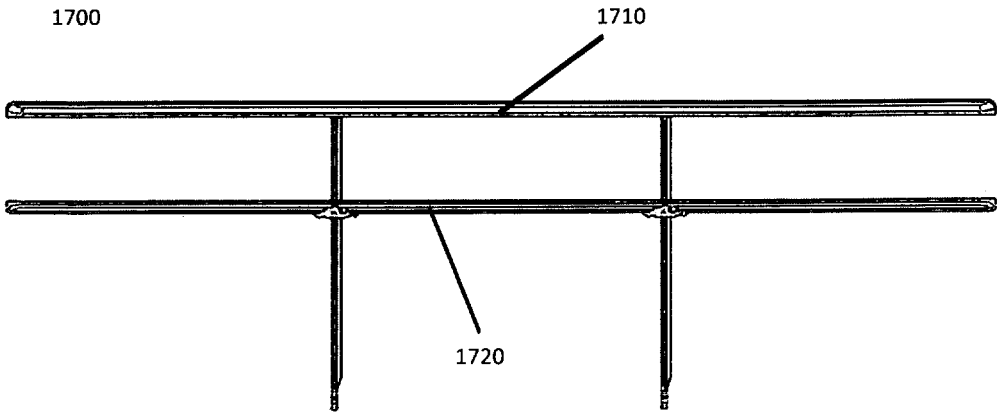
FIG. 17 is a perspective view of the present invention showing an alternative use of the invention by integrating two of each of the first members and the second clamping members in a multiply prong two piece device, in this view we see two first members integrated together with an elongated member and two second clamping members joined together with a elongated member. This variation of the invention would be used for a two hole punched paper.

As illustrated in FIG. 17, in accordance with one or more embodiments of the present invention shows a two tail device comprising two pieces, a top two tail member 1710 and a bottom two hole receiver member 1720. The attributes of the first member single tail 120 are the same for the two tail member 1710 except there are two of them integrated into a two tail device instead of a singular one. The attributes of the second clamping member 510 are the same for the two hole second clamping member receiver but are integrated into a two hole second clamping member receiver device instead of a singular one. This two tail 1710 two receiver 1720 device utilizes the same gripping and releasing mechanisms as the single prong device.

Figure 18:
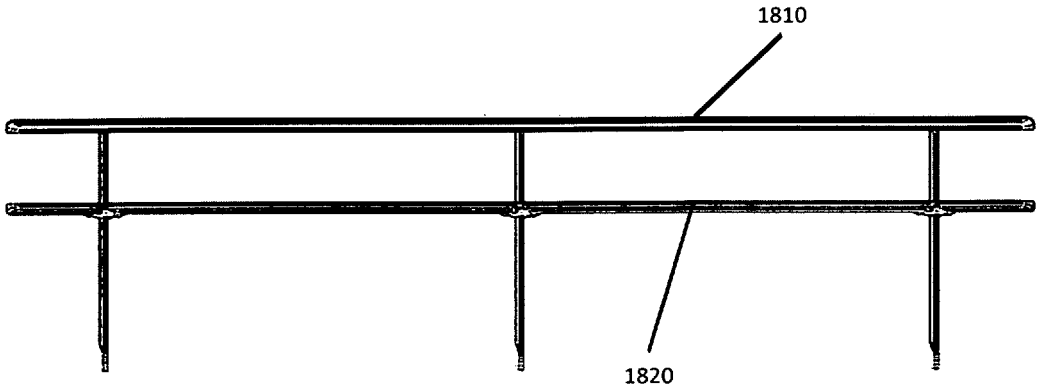
FIG. 18 is a perspective view of the present invention showing an alternative use of the invention by integrating three of each of the first members and the second clamping members in a multiply prong three tail device, in this view we see three first members integrated together with an elongated member and three second clamping members joined together with a elongated member. This variation of the invention would be used for a three hole punched paper.

As illustrated in FIG. 18, in accordance with one or more embodiments of the present invention shows a three prong device comprising two pieces, a top three tail member 1810 and a bottom three hole receiver member 1820. The attributes of the first member single tail 120 are the same for the three tail member 1810 except there are three of them molded into a three prong device instead of a singular one. The attributes of the second clamping member 510 are the same for the three hole receiver member but are molded into a three hole receiver member device instead of a singular one. This three tail 1810 three receiver 1820 device utilizes the same gripping and releasing mechanisms as the single prong device.

Figure 19:
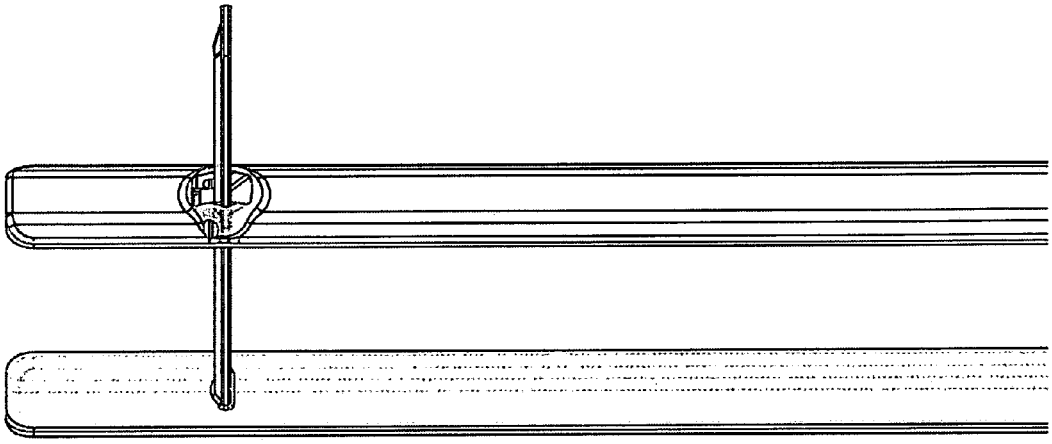
FIG. 19 is a perspective view of the present invention showing a close up of the multipronged device. This configuration of multiple first members and multiple second clamping members integrated with a elongated member may be in one or more configurations.

As illustrated in FIG. 19, in accordance with one or more embodiments of the present invention shows a close up view of the multi hole paper-binding device. This configuration of multiple first members and multiple second clamping members integrated with an elongated member may be in one or more tail and clamping configurations.

Figure 20:
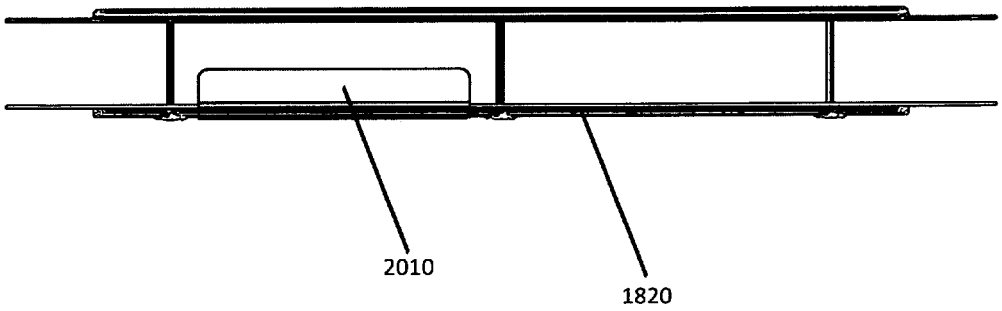
FIG. 20 is a perspective view of the present invention showing the label plate attached.

As illustrated in FIG. 20, in accordance with one or more embodiments of the present invention shows the label plate 2010 attached to the second clamping member 1820

Figure 21:
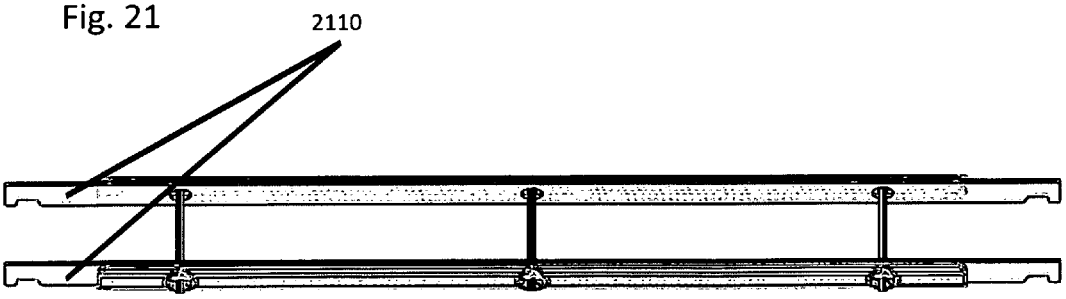
FIG. 21 is a perspective view of the present invention showing the hanger rods attached.

As illustrated in FIG. 21, in accordance with one or more embodiments of the present invention shows the hanger rods 2110 assembled with second clamping member 1820 and first member 1810

While the specific embodiments have been illustrated and described, numerous modifications come to mind without significantly departing from the spirit of the invention and the scope of protection is only limited by the scope of the accompanying Claims.

We claim:

1. A two-piece paper binding system for binding sheets of paper into a bound document comprising:

a first clamping member having a structural dome, said first clamping member further having an integral elongated tail with an elongated raised rib;

a second clamping member having a blade, the blade having a distal edge, the edge configured to engage the raised rib and to maintain the clamping member in a static position along the rib, the second clamping member further having an ejection hole, said ejection hole configured to permit a rod to enter said second clamping member, the rod entering at approximately a 90 degree angle from the blade to raise the blade and disengage the blade from the elongated raised rib allowing the elongated raised rib to be detached from the blade thereby permitting disassembly of the bound document.

2. The two-piece paper binding system as recited in claim 1, wherein said first clamping member is molded to form a singular piece with two or more joined elongated tails.

3. The two-piece paper binding system as recited in claim 1, wherein said second member is molded to form a singular piece with two or more joined clamping members.

4. The two-piece paper binding system as recited in claim 1, said system configured wherein an attachable plate for applying labels can be attached to said first member or second member.

5. The two-piece paper binding system as recited in claim 1, said paper binding system configured wherein an attachable hook can be sandwiched in between the first member and the paper and a second hook sandwiched in between the second member and the paper forming a system to suspend and hang documents on receivers in a file cabinet, said hook extends past the length of the paper to reach the file cabinet receivers for the hooks to rest on.

6. The two-piece paper binding system as recited in claim 1, wherein said first clamping member is further comprised of a beveled ramp, said beveled ramp positioned along said elongated raised rib, and said second clamping member is configured such that when the rod is pressed and wedged under the blade the rod travels up the beveled ramp to raise the blade and disengage the blade from the elongated raised rib, thereby allowing the elongated raised rib to be detached from the blade.

7. An apparatus for binding paper into a bound document comprising, a first clamping member, said first clamping member having an integral elongated tail, said elongated tail further comprised of an elongated raised rib, said elongated tail further comprised of a beveled ramp, said beveled ramp positioned along said elongated rib, a second clamping member having a blade, the blade having a distal edge configured to engage said elongated raised rib, means for inserting a rod into said second clamping member wherein said rod slides up on said beveled ramp and urges said blade to disengage said elongated raised rib.

8. A method for binding and unbinding papers having punched holes comprising, arranging the paper to align the punched holes into a channel, inserting a tail of a first clamping member through the channel wherein a portion of said tail protrudes through the channel, said first clamping member having a dome head, said first clamping member further having a raised elongated rib, attaching a second clamping member to the protruding portion of said tail, said second clamping member further having a blade, said blade further having a distal edge, said distal edge configured to engage said elongated rib, said second clamping member further having means for disengaging said blade from said rib when a rod is inserted into said second clamping member, wherein the rod urges said blade away from said rib, applying pressure to said second clamping member thereby compressing the papers together.

9. The method of claim 8 wherein said means for disengaging said blade from said rib is comprised of inserting the rod into an ejection hole, said ejection hole being positioned in said second clamping member such that the rod is oriented at approximately a 90 degree angle to the rib.

* * * * *